United States Patent [19]

Heilman et al.

[11] Patent Number: 5,035,341

[45] Date of Patent: Jul. 30, 1991

[54] CLOSURE CAP HAVING TAMPER INDICATING MEANS

[75] Inventors: Robert J. Heilman, Orland Park; H. Darrell Iler, Wheaton, both of Ill.

[73] Assignee: Continental White Cap, Inc., Norwalk, Conn.

[21] Appl. No.: 606,869

[22] Filed: Oct. 31, 1990

[51] Int. Cl.[5] ..... B65D 55/02

[52] U.S. Cl. ..... 215/230

[58] Field of Search ..... 215/230, 262, 216, 203, 215/270

[56] References Cited

U.S. PATENT DOCUMENTS

| | | | |
|---|---|---|---|
| 3,848,761 | 12/1974 | Libit | 215/220 |
| 3,974,929 | 8/1976 | Montgomery | 215/216 |
| 4,122,964 | 10/1978 | Morris | 215/260 |
| 4,442,945 | 4/1984 | Sandhaus | 215/218 |
| 4,479,585 | 10/1984 | Sandhaus | 215/218 |
| 4,502,605 | 3/1985 | Wloszczyna | 215/230 |
| 4,736,857 | 4/1988 | Monico, Jr. et al. | 215/230 |
| 4,747,497 | 5/1988 | Holman | 215/230 |
| 4,747,500 | 5/1988 | Gach et al. | 215/250 |
| 4,793,500 | 12/1988 | Harding | 215/230 |
| 4,793,504 | 12/1988 | Towns et al. | 215/250 |

*Primary Examiner*—Stephen Marcus

*Assistant Examiner*—Vanessa M. Roberts

*Attorney, Agent, or Firm*—Lockwood, Alex, Fitzgibbon & Cummings

[57] ABSTRACT

This relates to a mechanically actuated closure cap which is provided with a tamper indicating feature. The closure cap includes an end panel having a centrally located button that is normally in a button down position, but when the closure cap is applied to a container, it is mechanically actuated to a button up position. A translucent panel is fixedly applied to the closure cap in overlying relation to the end panel and there is positioned between the button and the translucent panel several possibilities of devices for indicating that the closure cap has been applied to a container and either is in its original position relative to the container or has been removed therefrom. In each instance indicia is involved with the indicia either indicating that the container has not been opened with this indicia disappearing when the container is opened, or the indicia indicating that the container has been opened and the indicia not appearing until the closure cap has been applied to the container and then removed therefrom. In each instance, either the removal of the indicia or the appearance of the indicia is not reversible.

12 Claims, 3 Drawing Sheets

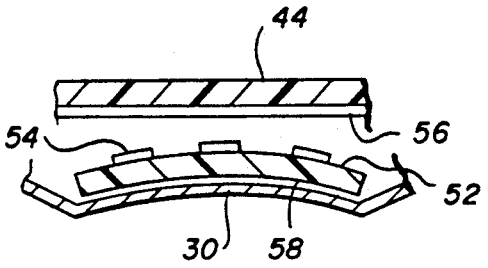
FIG. 6
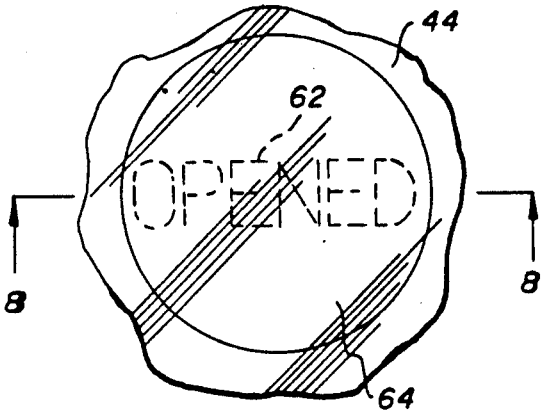
FIG. 7
FIG. 8
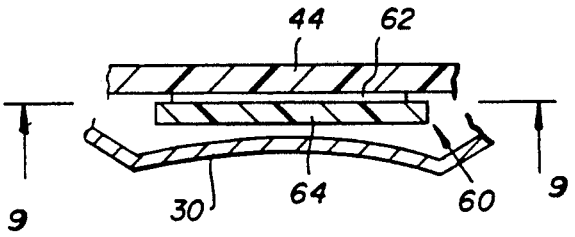
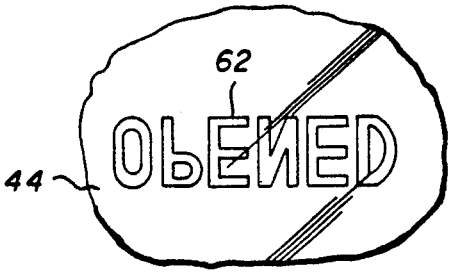
FIG. 9
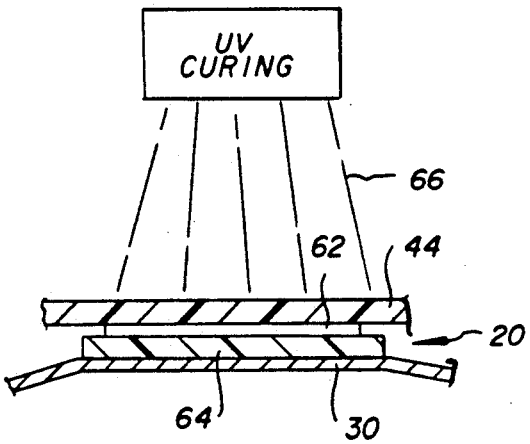
FIG. 10
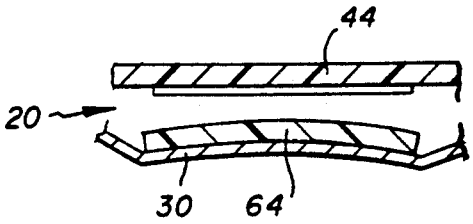
FIG. 11

FIG. 12
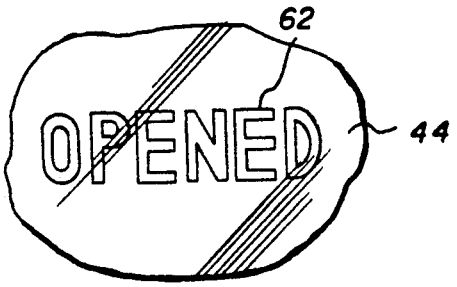
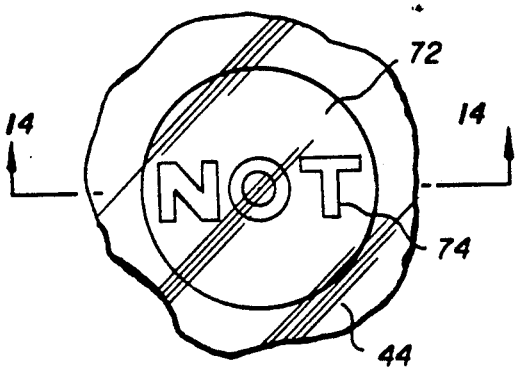
FIG. 13
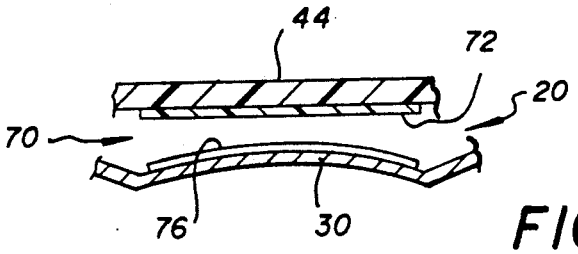
FIG. 14
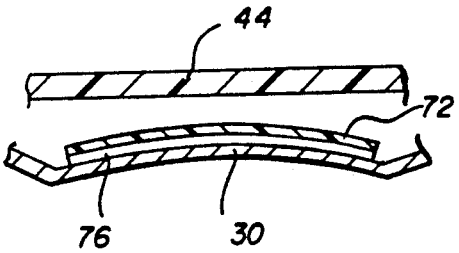
FIG. 15
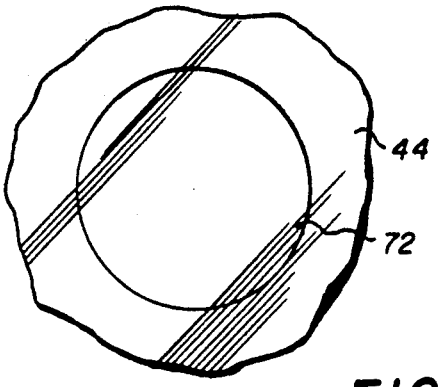
FIG. 16

CLOSURE CAP HAVING TAMPER INDICATING MEANS

This invention relates in general to new and useful improvements in closure caps for containers, and more particularly to a closure cap which is provided with a button that is deflected between a non-applied position and an applied position, and wherein the closure cap further includes a translucent panel overlying the button and there being tamper indicating means between the button and the translucent panel actuated in response to the deflection of the button first when the closure cap is applied to a container, and then when the closure cap is removed from the container.

BACKGROUND OF THE INVENTION

There has been recently developed by one of us a closure cap having an end panel including a centrally located button and mechanical acutating means around the button for deflecting the button from a down position to an up position when the closure cap is applied to a container with there being internal stresses which automatically return the button to the down position when the closure cap is removed from the container. While the position of the button indicates whether the closure cap is properly applied to a container and also produces a loud noise when the closure cap is removed from the container, if the closure cap is properly applied to a container and also produces a loud noise when the closure cap is removed from a container, if the closure cap is replaced, the button will again assume its up position and the closure cap will in no way indicate that the container has been previously opened.

SUMMARY OF THE INVENTION

In view of the foregoing, it is highly desirable that the above-described closure cap be provided with irreversible means which, when the closure cap is applied and removed from a container, will indicate a change in conditions in the button which are not reversible. For example, the closure cap may be constructed so that the tamper indicating means will indicate that the container has not been opened previously. On the other hand, the tamper indicating means may be initially shielded and to indicate that the container has been opened after the closure cap has been applied and removed from the container. These conditions are not reversible.

With the above and other objects in view that will hereinafter appear, the nature of the invention will be more clearly understood by reference to the following detailed description, the appended claims, and the several views illustrated in the accompanying drawings.

FIG. 6 is a transverse vertical sectional view similar to FIG. 4 but shows the closure cap after the closure cap has been applied and then removed with the tamper indicating means now being carried by the closure cap button.

FIG. 7 is a fragmentary top plan view of another closure cap utilizing a different form of tamper indicating/means which is normally blank until the closure cap has been applied and removed.

FIG. 8 is a fragmentary vertical sectional view taken generally along the line 8—8 of FIG. 7 and shows that the translucent panel has formed on the underside thereof indicia which is not visible in view of a film of the same color as the indicia being bonded to the underside of the translucent panel.

FIG. 9 is a fragmentary horizontal sectional view taken generally the line 9—9 of FIG. 8 and shows the indicia which is printed on the underside of the translucent panel.

FIG. 10 is a vertical sectional view similar to FIG. 8 and shows the closure cap after it has been applied to the container with the button in its up position and the film which underlies the translucent panel being cured.

FIG. 11 is another fragmentary vertical sectional view similar to FIG. 8 and shows the button returned to its down position with the cured film attached thereto.

FIG. 12 is a fragmentary top plan view of the button as it appears in FIG. 11.

FIG. 13 is a top plan view of the closure cap showing yet another form of tamper indicating means.

FIG. 14 is a fragmentary vertical sectional view taken generally along the line 14—14 of FIG. 13 and shows the details of the tamper indicating means.

FIG. 15 is a fragmentary vertical sectional view similar to FIG. 14 and shows the closure cap after it has been applied to a container and removed therefrom with the tamper indicating means having been actuated.

FIG. 16 is a fragmentary top plan view of the modified closure cap of FIG. 13 and shows as it appears in FIG. 15.

DESCRIPTION OF THE INVENTION

Figure 1:
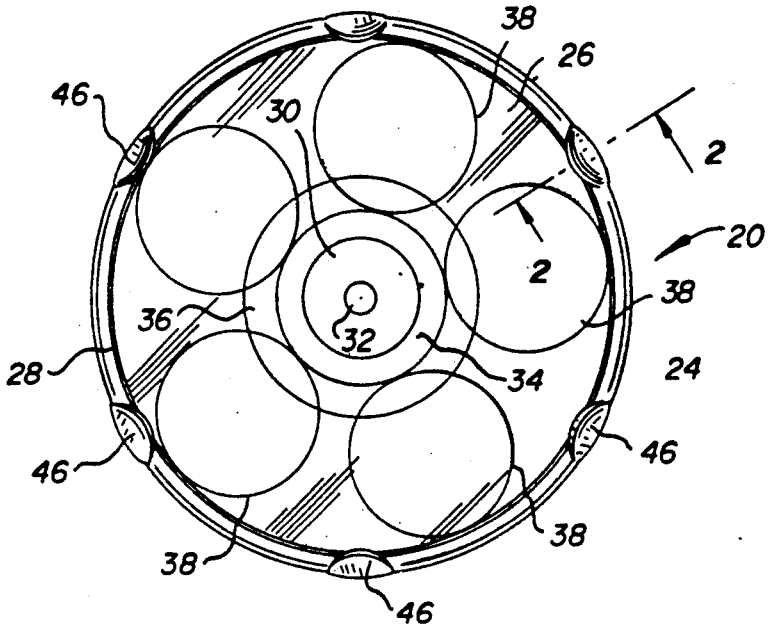
FIG. 1 is a plan view of a closure cap formed in accordance with this invention with there being applied to the closure cap a translucent panel overlying the end panel of the closure cap, the closure cap being free of tamper indicating means.
Figure 2:
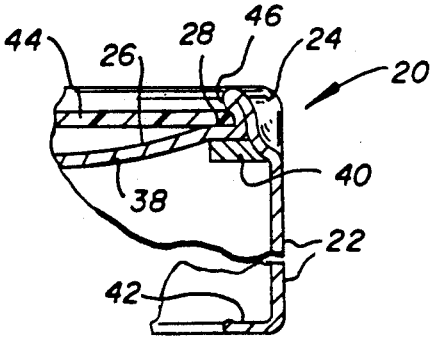
FIG. 2 is an enlarged fragmentary vertical sectional view taken generally along the line 2—2 of FIG. 1 shows the manner in which the translucent panel is secured to the closure cap.

Referring now to the drawings in detail, reference is first made to FIGS. 1 and 2 wherein there is illustrated a closure cap, generally identified by the numeral 20 which is the basis for this invention. The closure cap 20 is preferably formed of metal and includes a skirt 22 which is provided at its upper end with a reversely turned rib 24 surrounding an end panel 26. The end panel 26 is provided with a peripheral ledge 28.

The end panel 26, in cross section, as shown in FIG. 2, is slightly downwardly concave and includes a central button 30 that has a central post 32. The post 32 is flat and the button 30 slopes gently downwardly radially away from the button 30. The button 30 is surrounded by an annular upwardly and outwardly directed flange 34 which, in turn, is surrounded by a generally flat annular portion 36.

There is also formed in the end panel 26 a plurality of mechanical actuators in the form of downwardly directed bulges 38.

Referring once again to FIG. 2, it will be seen that underlying the end panel 26 is a gasket 40 which is in position to form a seal with an end sealing surface of a container (not shown). Further, the bulges 38 are positioned to have pressure exerted thereon by that same end sealing surface when the closure cap 20 is applied to a container which results in the deformation of the bulges 38 so as to effect a snapping action of the button 30 from a lower down position to an upper up position.

The skirt 22 is provided at circumferentially spaced intervals with radially inwardly projecting lugs 42 which are engageable beneath lugs on a neck finish of the unillustrated container.

The closure cap 20, as disclosed here, is known and per se does not form a part of this invention.

Further, the closure cap 20, as described here, has in the past been provided with a translucent panel 44 which is formed of a plastic material and overlies the end panel 26. In accordance with this invention, in lieu of adhesively bonding the panel 44 to the closure cap as has been done in the past, the upstanding rib 24, at circumferentially spaced intervals, is radially inwardly deformed to form detents 46 which overlie and retain in place the translucent panel 44.

Figure 5:
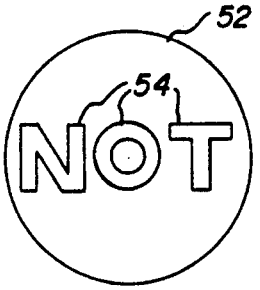
FIG. 5 is a horizontal sectional view taken generally along the line 5—5 of FIG. 4 and shows the arrangement of indicia on a wax coated disc initially carried by the translucent panel.

The closure cap, as described above and illustrated in FIGS. 1 and 2, is provided with tamper indicating means that are actuated in response to the application of the closure cap to a container and the removal of such closure cap from the container. Reference is made here to the first embodiment of the tamper indicating means which is illustrated in FIGS. 3–6 and generally identified by the numeral 50. The tamper indicating means 50 includes a member 52 which is formed of wax or a wax coated backing and, as is shown in FIG. 5, has projecting from the upper surface thereof indicia 54 such as the word "NOT" to indicate that an associated container has not been opened. The means 50 is loosely carried by the underside of the translucent panel 44 and the translucent panel 44 is preferably provided on the underside thereof with a coating 56 or is roughened to facilitate the light adherence of the member 52 to the translucent panel 44.

The tamper indicating means 50 also includes a thin layer of pressure sensitive adhesive 58 which is illustrated as being carried by the button 30 but which equally as well could be applied to the underside of the member 52 particularly when a backing is provided for the wax.

Figure 3:
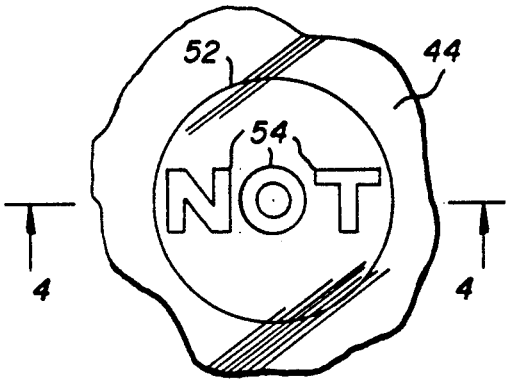
FIG. 3 is a top plan view of a central portion only of the closure cap of FIG. 1 provided with a first form of tamper indicating means which indicates an associated container has not been opened.
Figure 4:
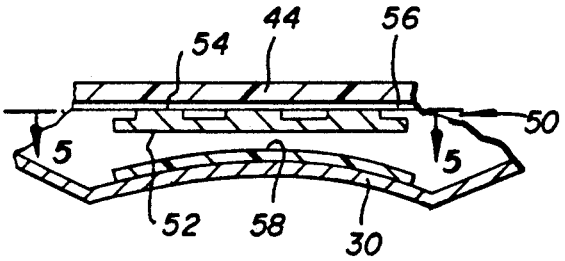
FIG. 4 is a fragmentary vertical sectional view taken generally along the line 4—4 of FIG. 3 and shows the specific construction of the closure cap, including the button thereof and the tamper indicating means.

As shown in FIG. 3, when the closure cap 20 is initially formed, the word "NOT" is readily visible through the transparent panel 44. Preferably, the wax of the member 52 is a dark color so as to be readily visible.

When the closure cap 20 is applied to a container, the button 30 is actuated so as to move to its button up position at which time the member 52 is tightly clamped against the coating 56 or the roughened undersurface of the translucent panel 44 so as to make certain that the indicia 54 is viewed through the translucent panel 44 to indicate that the container has not been opened. At this time the pressure sensitive adhesive 58 bonds the member 52 to the button 30. Thus when the closure cap 20 is removed from an associated container and the button 20 snaps back to its button down position, the member 52 is carried therewith as shown in FIG. 6 and the indicia identifying the closure cap as being part of a package which has not been opened, disappears.

It is to be understood that when the wax of the member 52 is tightly pressed up against the underside of the translucent panel 44 by the button in its button up position, the indicia 54 is somewhat flattened. Further, when the closure cap 20 is reapplied to a container, and the button 30 snaps up, it will cause the member 52 to hit the coating 56 or the roughened surface of the underside of the translucent panel 44 with enough force to uniformally make the indicia 54 reappear since intimate contact is necessary.

Reference is now made to FIGS. 7 through 12 wherein there are illustrated a second form of tamper indicating means generally identified by the numeral 60. The tamper indicating means 60 includes indicia 62 printed on the underside of the translucent panel 44 with typical indicia being the word "OPENED". A tacky UV curable film 64 is applied to the underside of the translucent panel 44 in alignment with the printed indicia 62. It is to be understood that the member 64 will be of a color corresponding to the color of the printed indicia 62 so that when the member 64 is carried by the translucent panel 44, the printed indicia 62 will not be visible.

The printed indicia is clearly shown in FIG. 9 as applied to the underside of the translucent panel 44.

In use, when the closure cap 20 is applied to a container and the button 30 is mechanically actuated to its button up position, the button 30 will tightly clamp the film 64 to the underside of the translucent panel 44. At this time, the film 64 is subject to UV curing as schematically illustrated at 66 in FIG. 10. The UV curing of the film 64 results in two happenings. First of all, the film 64 becomes bonded to the button 30. Secondly, the upper surface of the film 64 will no longer bond to the underside of the translucent panel 44 as is required to mask the indicia 62. Thus when the closure cap 20 is removed from an associated container, and the button 30 returns to its button down position, the film 64 is drawn away from the translucent panel 44 and the printed indicia 62 becomes readily visible through the translucent panel 44 as is clearly illustrated in FIG. 12. Further, should the closure cap 20 be reapplied to the container, the film 64 will not become intermeshed with the lower surface of the translucent panel 44 so as to properly blank out the printed indicia 62. Therefore, the warning word "OPENED" or like word will after an intial utilization of the closure cap and an opening of the container, continue to indicate that the container had been previously opened.

Referring now to FIGS. 13–16, it will be seen that there is illustrated still another form of tamper indicating means generally identified by the numeral 70. In this instance, the tamper indicating means 70 employs the principles of a child's slate consisting of a sheet with a fluorescent dye and a white vinyl background sheet such as is broadly disclosed in U.S. Pat. Nos. 3,761,343 and 4,011,665.

In particular, the sheet with the fluorescent dye will be the translucent panel 44 while a sheet 72 presenting the white vinyl background will be applied to the underside thereof in a manner wherein the sheet 72 is removable. Further, either the translucent panel 44 or the sheet 72 must be flexible so that opposing surfaces of the translucent panel 44 and sheet 72 may be brought into intimate contact so as to present an indicia message 74 as shown in FIG. 13, the message preferably being in the form of the word "NOT".

Further, the button 30 will have a suitable pressure sensitive adhesive coating 76 on the upper surface thereof.

In its as manufactured form, the closure cap 20 with the tamper indicating means 70 incorporated therein will have the word "NOT" appearing on the top surface thereof. The word "NOT" will continue to appear on the top surface of the closure cap when it is applied to a container even though the button 30 has snapped to its button up position. In fact, it is also envisioned that the indicia 74 not be incorporated in the tamper indicating means 70 until the closure cap has been applied to a container, at which time the indicia 74 may be caused to appear on the surface of the sheet 72 in a suitable stamping operation.

When the closure cap is removed from the container, due to the fact that the sheet 72 has now become bonded to the button 70 by way of the pressure sensitive adhesive 76, there will be no longer an intimate contact between the surfaces of the translucent panel 44 and the sheet 72 which produced the indicia 74 and therefore the indicia 74 will be eliminated and the closure cap when viewed from the top, will be blank as is shown in FIG. 16.

Although only several preferred embodiments of tamper indicating means have been specifically illustrated and described, it is to be understood that minor variations may be made in the tamper indicating means without departing from the spirit and scope of the invention as defined by the appended claims.

We claim:

1. A closure cap having tamper indicating means, said closure cap comprising a cap member including an end panel having incorporated therein a mechanically actuated button, said button having a normal down position, actuating means carried by said end panel for automatically moving said button to an up position when said cap member is applied to a container, said tamper indicating means including a translucent panel carried by said cap member in overlying relation to said end panel spaced from said button in said button down position and engageable by said button in said button up position, a film disposed intermediate said button and said translucent panel, and indicia forming means selectivey carried by said film and said translucent panel for indicating the status of said closure cap.

2. A closure cap according to claim 1 wherein said film is formed of a colored wax coated disc having a surface opposing said translucent panel defining said indicia forming means, said indicia forming means not being visible in an unapplied condition of said cap member and becoming visible when said button in said button up position presses said indicia forming means against said translucent panel.

3. A closure cap according to claim 2 wherein at least one of opposed surfaces of said button and said film carries a layer of pressure sensitive adhesive for bonding said film to said button in a button up position and withdrawing said indicia forming means from said translucent panel in a container opened button down position.

4. A closure cap according to claim 1 wherein said indicia forming means is in the form of indicia printed on an underside of said translucent panel, said film being loosely bonded to said translucent panel in underlying relation to said indicia and providing an indicia hiding background for said indicia in both an original button down position and an initial button up position.

5. A closure cap according to claim 4 together with means for bonding said button to said film in an initial button up position whereby when said cap member is released from an associated container and said button moves again to said button down position, said film is withdrawn from said translucent panel and said indicia becomes visible to indicate that said cap member has been applied and removed.

6. A closure cap according to claim 4 wherein said film is in the form of a tacky UV curable material directly initially bonded to said translucent panel.

7. A closure cap according to claim 5 wherein said film is in the form of a tacky UV curable material directly initially bonded to said translucent panel.

8. A closure cap according to claim 7 wherein said tacky UV curable material is cured when said cap member is applied to a container and said button is in said button up position with the curing of said tacky UV curable material forming said means for bonding said button to said film.

9. A closure cap according to claim 8 wherein the curing of said tacky UV curable material prevents the bond between said film and said translucent panel from again being formed when said cap member is reapplied and said button again assumes said button up position whereby said indicia remains visible.

10. A closure cap according to claim 1 wherein said film is formed of an opaque material and an underside of said translucent panel having a coating of an iridescent dye wherein said indicia forming means is the selected contact between said iridescent dye coating and said opaque material.

11. A closure cap according to claim 10 wherein at least one of opposed surfaces of said button and said film carries a layer of pressure sensitive adhesive for bonding said film to said button in a button up position and withdrawing said film from said translucent panel to destroy indicia forming contact between said film and said translucent panel.

12. A closure cap according to claim 1 wherein said end panel has a peripheral ledge on which said translucent panel is seated, said ledge being surrounded by an upstanding bead, and said bead having circumferentially spaced deformed areas in the form of radially inwardly directed detents overlying peripheral edge portions of said translucent panel.

* * * * *